US012571602B2

(12) United States Patent
Ye

(10) Patent No.: US 12,571,602 B2
(45) Date of Patent: Mar. 10, 2026

(54) TRIGGER ASSEMBLY

(71) Applicant: Shadow Systems LLC, Plano, TX (US)

(72) Inventor: Benjamin Ni Ye, North Richland Hills, TX (US)

(73) Assignee: Shadow Systems LLC, Plano, TX (US)

( * ) Notice: Subject to any disclaimer, the term of this patent is extended or adjusted under 35 U.S.C. 154(b) by 186 days.

(21) Appl. No.: 18/389,133

(22) Filed: Nov. 13, 2023

(65) Prior Publication Data

US 2025/0155213 A1 May 15, 2025

(51) Int. Cl.
*F41A 19/10* (2006.01)

(52) U.S. Cl.
CPC ..... *F41A 19/10* (2013.01)

(58) Field of Classification Search
CPC ..... F41A 19/10; F41A 19/12
See application file for complete search history.

(56) References Cited

U.S. PATENT DOCUMENTS 4,539,889 A 9/1985 Glock
9,140,510 B1 9/2015 Hsia
11,274,893 B1 3/2022 Kras et al.
2011/0289811 A1 12/2011 Gentilini et al.
2015/0068092 A1 3/2015 Kallio
2019/0107353 A1 4/2019 Thomele et al.
2022/0364813 A1 11/2022 Underwood et al.
2023/0251050 A1* 8/2023 Fellows ..... F41A 17/56 42/69.01
2024/0271897 A1* 8/2024 Horner ..... F41A 19/12
2025/0130002 A1* 4/2025 Gigliotti ..... F41A 19/10

OTHER PUBLICATIONS

WIPO, Written Opinion issued in related International Application No. PCT/US2024/055721, dated Nov. 4, 2025.
WIPO, International Search Report issued in related International Application No. PCT/US2024/055721, dated Nov. 4, 2025.

* cited by examiner

*Primary Examiner* — J. Woodrow Eldred
(74) *Attorney, Agent, or Firm* — Kim IP Law Group LLC

(57) ABSTRACT

A trigger assembly can include a sear defining a trigger bar engagement surface and a reset notch; and a trigger bar including an upper leg, the upper leg defining a sear engagement surface, the upper leg deflectable from a default leg shape to a disconnected leg shape, the sear engagement surface laterally aligned with the trigger bar engagement surface when the upper leg is in the default leg shape, the sear engagement surface laterally misaligned from the trigger bar engagement surface when the upper leg is in the disconnected leg shape.

14 Claims, 14 Drawing Sheets

TRIGGER ASSEMBLY

TECHNICAL FIELD

This disclosure relates to a trigger assembly. More specifically, this disclosure relates to a trigger assembly for a firearm.

BACKGROUND

Firearms can include a trigger, which can be actuated to fire the firearm. Firearms that are intended for precision shooting often have triggers that are relatively vulnerable to inadvertent actuation, which can lead to accidental or negligent discharges of the firearm, either from mechanical failure or user error. While some firearms have triggers that require long or heavy trigger pulls intended to provide greater safety against inadvertent trigger actuation, such can make the firearm much more difficult to shoot accurately.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a trigger assembly comprising a sear defining a trigger bar engagement surface and a reset notch; and a trigger bar comprising an upper leg, the upper leg defining a sear engagement surface, the upper leg deflectable from a default leg shape to a disconnected leg shape, the sear engagement surface laterally aligned with the trigger bar engagement surface when the upper leg is in the default leg shape, the sear engagement surface laterally misaligned from the trigger bar engagement surface when the upper leg is in the disconnected leg shape.

Also disclosed is a firearm comprising a striker defining a sear engagement lug; and a trigger assembly comprising a sear, the sear defining a striker engagement surface and a sear pin hole, the sear pin hole defining a sear axis, the sear engagement lug contacting the striker engagement surface in primary engagement region when the striker is in a cocked position, the primary engagement region defined between an initial engagement point and a transition point, the sear defining a final engagement point on the striker engagement surface opposite from the initial engagement point, the sear defining a radius extending from the sear axis to the striker engagement surface, a length of the radius increasing at a decreasing rate from the transition point to the final engagement point.

Also disclosed is a method of operating firearm comprising a trigger assembly, a frame, and a slide, the trigger assembly comprising a trigger bar, a sear, and a disconnector, the method comprising moving the trigger bar in a rearward direction from a forward trigger bar position to an intermediate trigger bar position with an upper leg of the trigger bar in a default leg shape to contact a sear engagement surface of the upper leg with a trigger bar engagement surface of the sear; moving the trigger bar further in the rearward direction from the intermediate trigger bar position to a rearward trigger bar position to rotate the sear from an engagement sear position to a disengaged sear position due to contact between the sear engagement surface and the trigger bar engagement surface, the sear contacting a striker of the firearm in the engagement sear position; releasing the striker of the firearm in a forward direction as the sear rotates from the engagement position to the disengaged sear position, releasing the striker causing the firearm to fire a cartridge; moving the slide in the rearward direction relative to the frame to deflect an upper arm of the disconnector from a default arm shape to a disconnected arm shape; and deflecting the upper leg from the default leg shape to a disconnected leg shape through contact between the upper arm and the upper leg to misalign the sear engagement surface of the upper leg from the trigger bar engagement surface of the sear.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
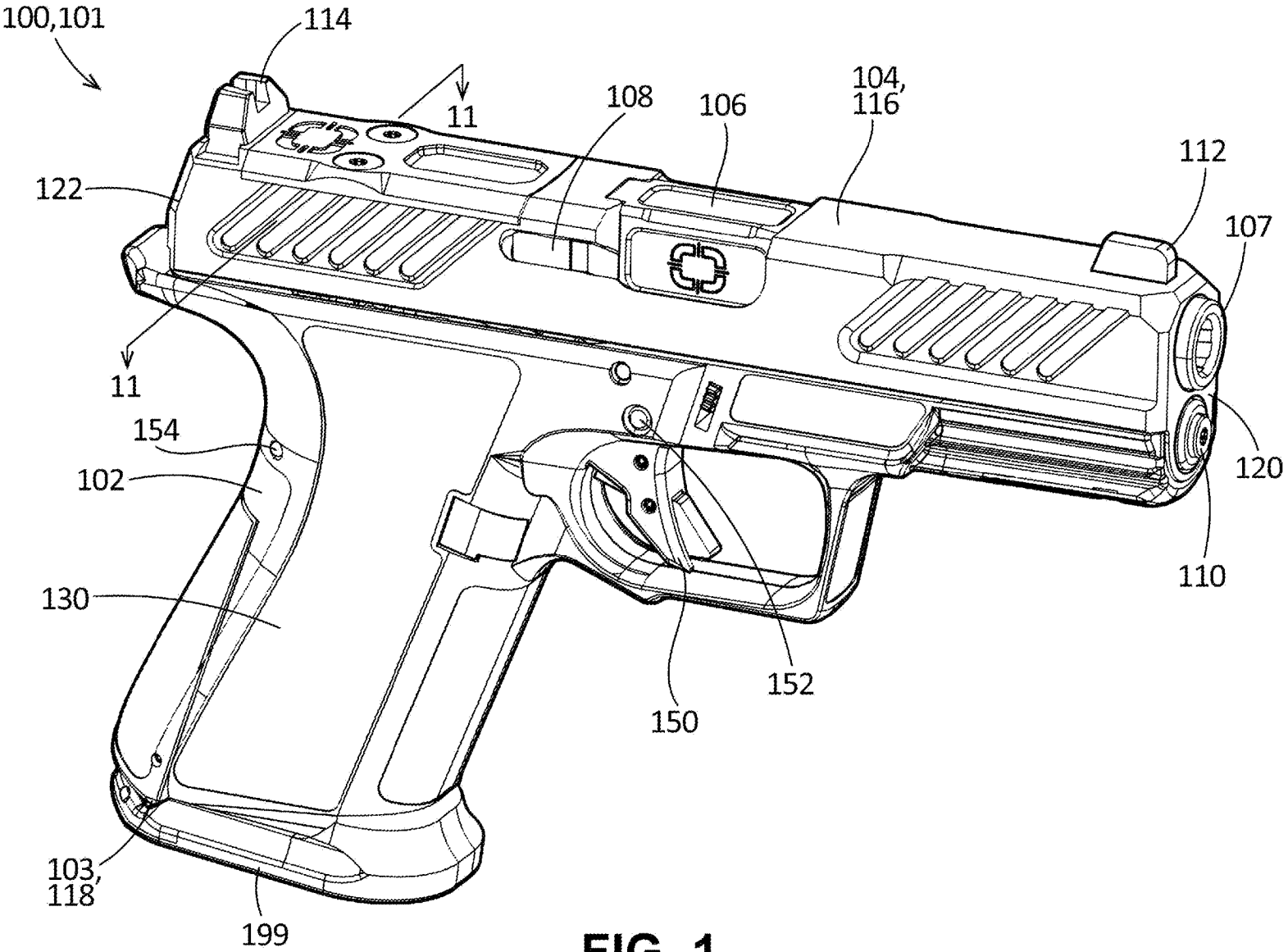
FIG. 1 a perspective view of a firearm comprising a trigger assembly in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed, that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a firearm and associated methods, systems, devices, and various apparatus. The firearm can comprise a trigger assembly, a frame, and a slide. It would be understood by one of skill in the art that the firearm is described in but a few exemplary aspects among many. No particular terminology or description should be considered limiting on the disclosure or the scope of any claims issuing therefrom.

FIG. 1 is a perspective view of a firearm 100 comprising a trigger assembly 150 in accordance with one aspect of the present disclosure. In the aspect shown, the firearm 100 can be a pistol 101. The firearm 100 can further comprise a frame 102, a slide 104, a barrel 106, an extractor 108, a recoil spring assembly 110, a front sight 112, and a rear sight 114.

The firearm 100 can define a top 116, a bottom 118, a front 120, and a rear 122. The top 116 can be at least partially defined by an upper surface of the slide 104. The front sight 112 and the rear sight 114 can be located at the top 116 of the firearm 100. A grip 103 of the frame 102 can extend downwards away from the slide 104 and can terminate proximate to the bottom 118 of the firearm 100. In some aspects, the grip 103 can receive a magazine 199. The front sight 112 and a muzzle 107 of the barrel 106 can be positioned at or proximate to the front 120 of the firearm 100. The rear sight 114 can be positioned at or proximate to the rear 122 of the firearm 100.

A right side 130 of the firearm 100 is shown. The firearm 100 can define a left side 1132 (shown in FIG. 11) of the firearm 100, which can be positioned opposite from the right side 130 of the firearm 100.

The trigger assembly 150 can be housed at least partially within the frame 102. In the present aspect, the trigger assembly 150 can be secured within the frame 102 by a trigger hinge pin 152 and a trigger housing pin 154.

Figure 2:
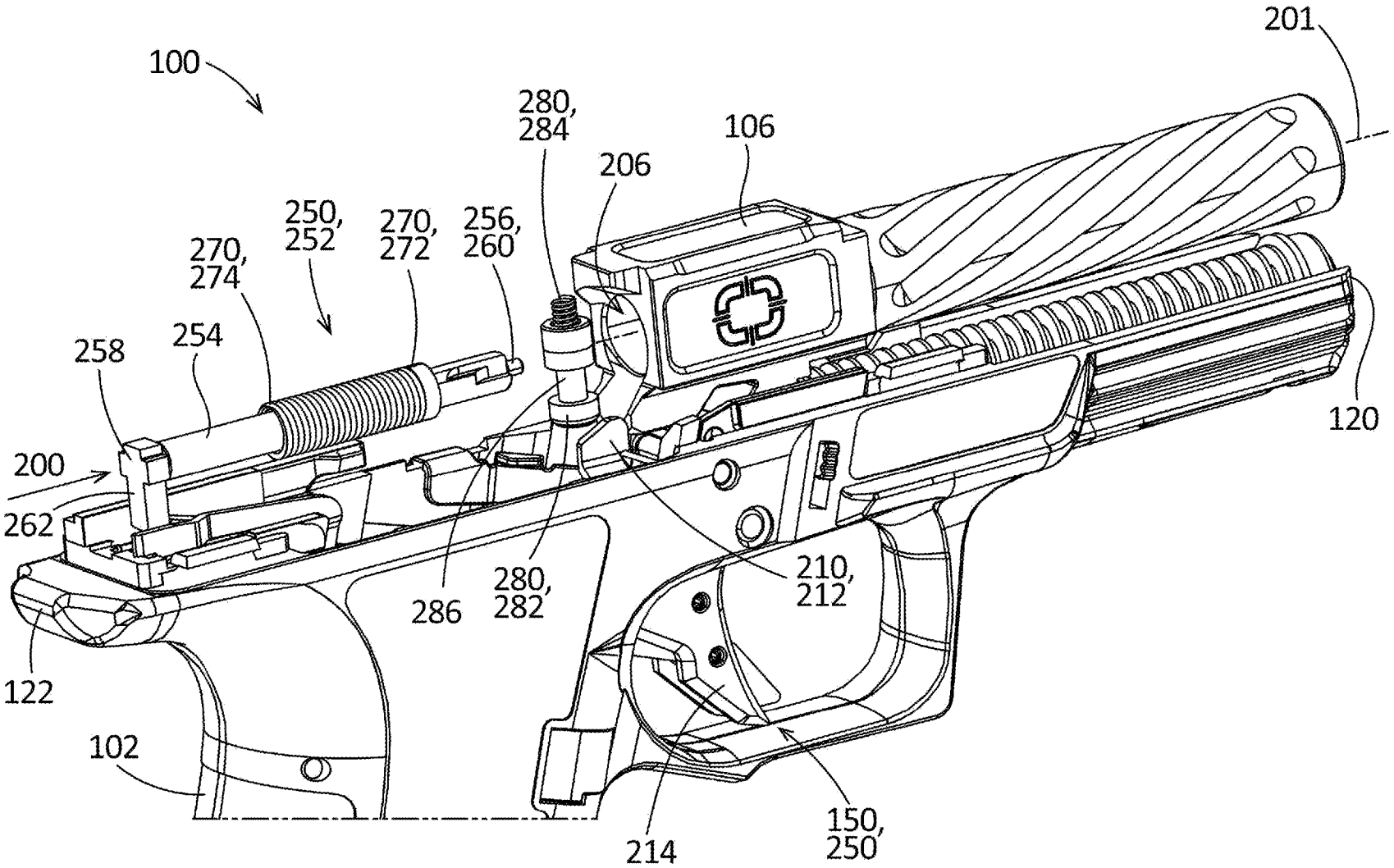
FIG. 2 is a right-side perspective view of the firearm of FIG. 1 with a slide of the firearm removed from view.

FIG. 2 is a right-side perspective view of the firearm 100 of FIG. 1 with the slide 104 (shown in FIG. 1) removed from view. As shown, the firearm 100 can comprise a fire control mechanism 250, which can comprise the trigger assembly 150 and a striker assembly 252. In some aspects, the fire control mechanism 250 can further comprise a firing pin safety assembly 280.

The striker assembly 252 can comprise a striker 254 and a striker biasing member 270. The striker 254 can define a front end 256 and a rear end 258. The front end 256 of the striker 254 can face the front 120 of the firearm 100. The rear end 258 of the striker 254 can face the rear 122 of the firearm 100. The front end 256 can define a firing pin 260. The firing pin 260 can be a protuberance, which can be configured to strike a primer of a cartridge (not shown) positioned in a chamber 206 of the barrel 106 when the fire control mechanism 250 is actuated.

The striker 254 can further define a sear engagement lug 262. The sear engagement lug 262 can extend downwards toward the frame 102 of the firearm 100. In the present aspect, the sear engagement lug 262 can be positioned at the rear end 258 of the striker 254. In the view shown, the fire control mechanism 250 is in a cocked configuration. In the cocked configuration, the striker 254 can be secured in a cocked position, as shown, through engagement of the sear engagement lug 262 with a sear 362 (shown in FIG. 3) of the trigger assembly 150.

In the present aspect, the striker biasing member 270 can be a compression spring, such as a coil spring for example and without limitation, though it should be appreciated that various embodiments of the subject disclosure are not limited to any particular type or kind of biasing member. The striker 254 can extend at least partially through the striker biasing member 270. The striker biasing member 270 can define a front end 272 and a rear end 274. The front end 272 of the striker biasing member 270 can couple to the striker 254. The rear end 274 can be compressed against the slide 104 (shown in FIG. 1) when the striker assembly 252 is installed in the slide 104. With the fire control mechanism 250 in the cocked configuration and the striker 254 in the cocked position, the striker biasing member 270 is in a compressed state. The striker biasing member 270 can bias the striker 254 in a forward direction 200 towards the front 120 of the firearm 100. In some aspects, the forward direction 200 can be parallel to a barrel axis 201 of the barrel 106. As described in further detail below, actuation of the fire control mechanism 250 can propel the striker 254 in the forward direction 200 under biasing force provided by the striker biasing member 270.

The firing pin safety assembly 280 can prevent discharge of the firearm 100 should the striker 254 be inadvertently released without actuating the trigger assembly 150. The firing pin safety assembly 280 can comprise a firing pin safety 282 and a biasing member 284. The firing pin safety 282 can define a clearanced portion 286. The clearanced portion 286 can be defined by a groove, slot, notch, reduced portion, or other feature.

The firing pin safety 282 can be movable upwards and downwards between a firing position and a safe position (shown in FIG. 2). In the present aspect, the firing position can be an upper position wherein the firing pin safety is closer to the top 116 (shown in FIG. 1) of the firearm 100, and the safe position can be a lower position that is further from the top 116. When the firing pin safety assembly 280 is mounted in the slide 104 (shown in FIG. 1), the biasing member 284 can bias the firing pin safety 282 downwards towards the safe position.

In the safe position, the clearanced portion 286 can be misaligned from the striker 254 such that the firing pin safety 282 interferes with the forward path of the striker 254 in the forward direction 200 and prevents the striker 254 from moving forward far enough for the firing pin 260 to contact a cartridge (not shown) in the chamber 206. In the firing position, the clearanced portion 286 can be aligned to provide a clear forward path of striker 254 in the forward direction 200 to travel sufficiently far forward for the firing pin 260 to strike and ignite the primer of a cartridge in the chamber 206.

A trigger 214 of the trigger assembly 150 can be connected a trigger bar 210 of the trigger assembly 150. In FIG. 2, the trigger 214 is shown in a forward trigger position. In some aspects, the forward trigger position can be the default position (i.e. when no external force is acting on the trigger 214, the trigger 214 can return to the forward trigger position). With the trigger 214 in the forward trigger position, the trigger bar 210 can also be in a corresponding forward trigger bar position. Pulling the trigger rearward can move the trigger bar 210 from the forward trigger bar position (shown in FIGS. 2 and 7) to an intermediate trigger bar position (shown in FIGS. 3 and 8), and then to a rearward trigger bar position (shown in FIGS. 9, 11, and 13-14). In some aspects, the intermediate trigger bar position can be the forwardmost position.

With the trigger bar 210 in the forward trigger bar position, the firing pin safety 282 can be positioned in the safe position under biasing force from the biasing member 284. The trigger bar 210 can define a ramped tab 212, which can be configured to engage with and actuate the firing pin safety 282. When a trigger 214 of the trigger assembly 150 is pulled and the trigger bar 210 moves rearward from the forward trigger bar position to the intermediate trigger bar position, the ramped tab 212 can contact and lift the firing pin safety 282 from the safe position (shown) to the firing position. The trigger 214 can be pulled further rearward to move the trigger bar 210 from the intermediate trigger bar position to the rearward trigger bar position, wherein the striker 254 can be released to fire the firearm 100 as described in greater detail below.

Figure 3:
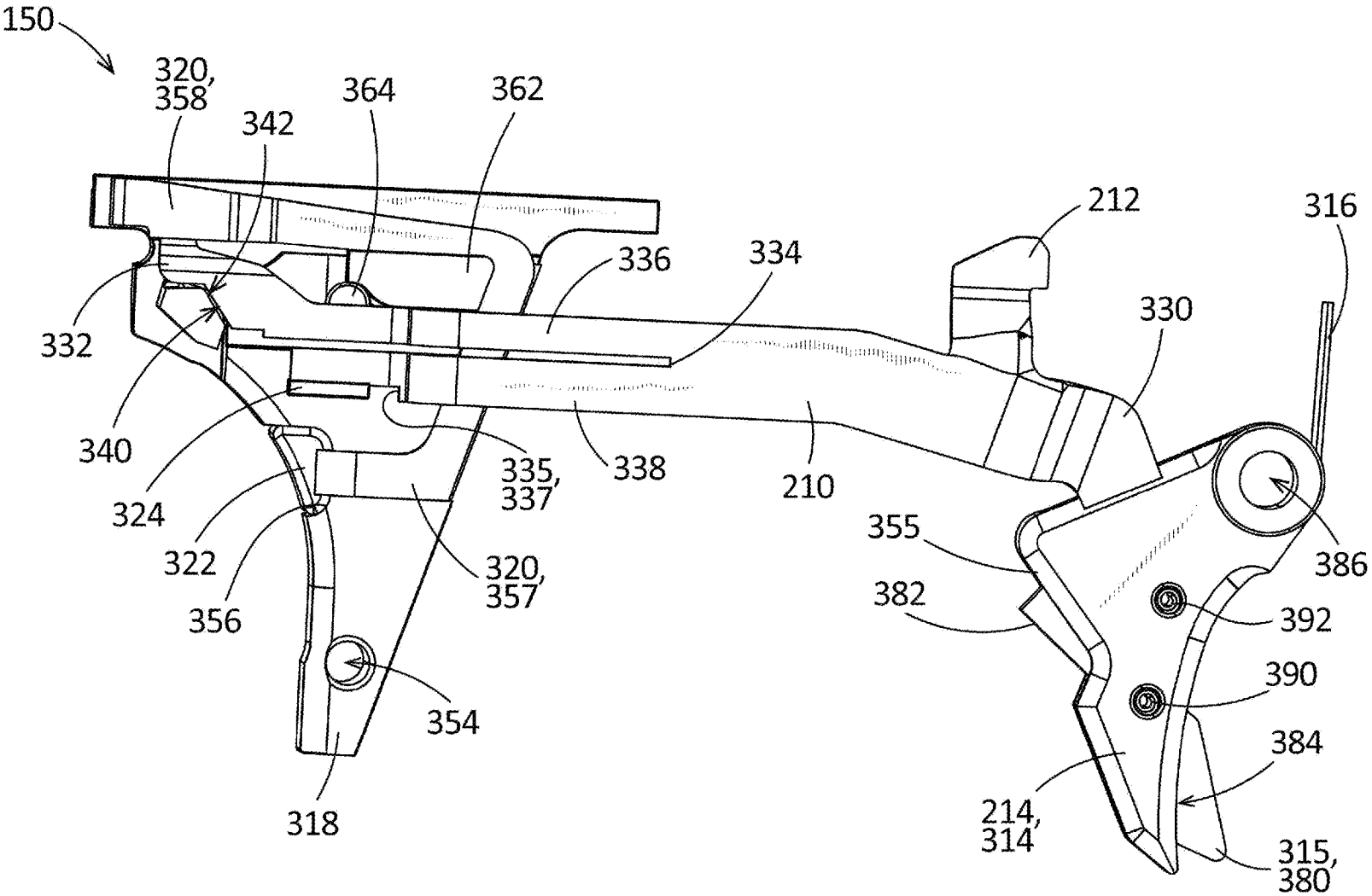
FIG. 3 is a right-side view of the trigger assembly of FIG. 1, with a trigger bar of the trigger assembly depicted in an intermediate position.

FIG. 3 is a right-side view of the trigger assembly 150 of the aspect of FIG. 1, with the trigger bar 210 depicted in the intermediate position. The trigger assembly 150 can comprise the trigger bar 210, the trigger 214, a trigger biasing member 316, a trigger housing 318, a disconnector 320, a disconnector locking piece 322, the sear 362, a sear pin 364, and a sear biasing member 462 (shown in FIG. 4).

The trigger 214 can define a pin opening 386, which can receive the trigger hinge pin 152 (shown in FIG. 1). The trigger 214 can rotate, or hinge, about the trigger hinge pin 152 with respect to the frame 102 (shown in FIG. 1). The trigger biasing member 316 can bias the trigger 214 about the trigger hinge pin 152 towards the forward position shown and discussed above with respect to FIG. 2. In the present aspect, the trigger biasing member 316 can bias the trigger 214 in a counterclockwise direction about the trigger hinge pin 152 with respect to the present viewing angle. In the present aspect, the trigger biasing member 316 can be a torsion spring; however, in some aspects, the trigger biasing member 316 can be a different type of biasing member, such as a tension spring, a compression spring, or any other suitable biasing member.

A front end 330 of the trigger bar 210 can be pinned to the trigger 214 by a pin 392. The biasing force exerted by the trigger biasing member 316 can pull the trigger bar 210 in the forward direction as the trigger 214 rotates about the trigger hinge pin 152 within the frame 102 (shown in FIG. 1). The ramped tab 212 can be positioned proximate to the front end 330 of the trigger bar 210.

The trigger 214 can comprise a trigger body 314 and a trigger safety blade 315. The trigger safety blade 315 can be fixed to the trigger body 314 by a pin 390. The trigger safety blade 315 can be configured to rotate relative to the trigger body 314 about the pin 390. The trigger safety blade 315 can define a first end 380 and a second end 382. The trigger safety blade 315 is shown in a safe position. In the safe position, the first end 380 can extend outward from a face 384 of the trigger body 314 in a forward direction, and the second end 382 can extend outward from a rear 355 of the trigger body 314. The second end 382 can engage with the frame 102 (shown in FIG. 1) to prevent the trigger body 314 from being depressed towards the frame 102 when the trigger safety blade 315 is in the safe position. When a user presses on the face 384 of the trigger body 314, the first end 380 can be pressed into the trigger body 314, thereby causing the trigger safety blade 315 to rotate about the pin 390 in a clockwise direction with respect to the present viewing angle to a firing position. The rotation of the trigger safety blade 315 can cause the second end 382 to retract into the trigger body 314, thereby disengaging the second end 382 from the frame 102 and allowing the trigger body 314 to be depressed towards the frame 102 to fire the firearm 100 (shown in FIG. 1).

The trigger housing 318 can define a trigger housing pin hole 354, which can receive the trigger housing pin 154 (shown in FIG. 1) when the trigger housing 318 is installed in the frame 102.

The disconnector 320 can be coupled to the trigger housing 318. The trigger housing 318 can define a disconnector mounting recess 356, which can receive the disconnector 320. In the present aspect, a lower arm 357 of the disconnector 320 can be received in the disconnector mounting recess 356. In some aspects, the disconnector locking piece 322 can secure the disconnector 320 in the disconnector mounting recess 356. In some aspects, the trigger assembly 150 can omit the disconnector locking piece 322. For example and without limitation, in some aspects, the disconnector mounting recess 356 can be a slot or hole, and the disconnector 320 can stab directly into the disconnector mounting recess 356. An upper arm 358 of the disconnector 320 can engage with a rear end 332 of the trigger bar 210. The upper arm 358 can be configured to resiliently deflect during operation of the firearm 100 (shown in FIG. 1) from a default arm shape (shown in FIGS. 3, 4, 6-8, and 11) and a disconnected arm shape (shown in FIGS. 13 and 14).

The trigger bar 210 can define a slot 334 extending into the rear end 332 of the trigger bar 210 and extending forwards towards the front end 330 of the trigger bar 210. The slot 334 can split the rear end 332 into an upper leg 336 and a lower leg 338.

The trigger housing 318 can define a guide shelf 324. The rear end 332 can ride along the guide shelf 324 as the trigger bar 210 moves in the forward and rearward directions. In the present aspect, the lower leg 338 can ride on the guide shelf 324. In some aspects, the guide shelf 324 can fit into the slot 334, and the slot 334 can ride along the guide shelf 324. In the aspect shown, the lower leg 338 can define a cutout 335 with a shoulder 337 proximate to the rear end 332, and the cutout 335 can ride along the guide shelf 324. In some aspects, the shoulder 337 can be positioned to limit rearward travel of the trigger bar 210, which can reduce or substantially eliminate overtravel of the trigger 214 when pulled by a user.

The upper leg 336 can engage with the disconnector 320 at the rear end 332 of the trigger bar 210. As described in greater detail below, the disconnector 320 and the upper leg 336 of the trigger bar 210 can be configured to resiliently deflect during operation of the firearm 100 (shown in FIG. 1) from a default leg shape (shown in FIGS. 3, 4, 6-9, and 11) and a disconnected leg shape (shown in FIGS. 13 and 14). The lower leg 338 can brace against the trigger housing 318, and the upper leg 336 can function as a leaf spring as described in greater detail below with respect to FIGS. 11-14.

The upper leg 336 can define a sear engagement surface 340, which can be configured to engage a trigger bar engagement surface 342 of the sear 362 when the trigger bar 210 is in the intermediate position, as shown. The sear 362 can be secured to the trigger housing 318 with the sear pin 364. The sear 362 can be configured to rotate about the sear pin 364. Engagement between the sear engagement surface 340 and the trigger bar engagement surface 342 can cause the sear 362 to rotate about the sear pin 364 when the trigger 214 is pulled and the trigger bar 210 is moved from the intermediate position to the rearward position, as further described below with respect to FIG. 9.

Figure 4:
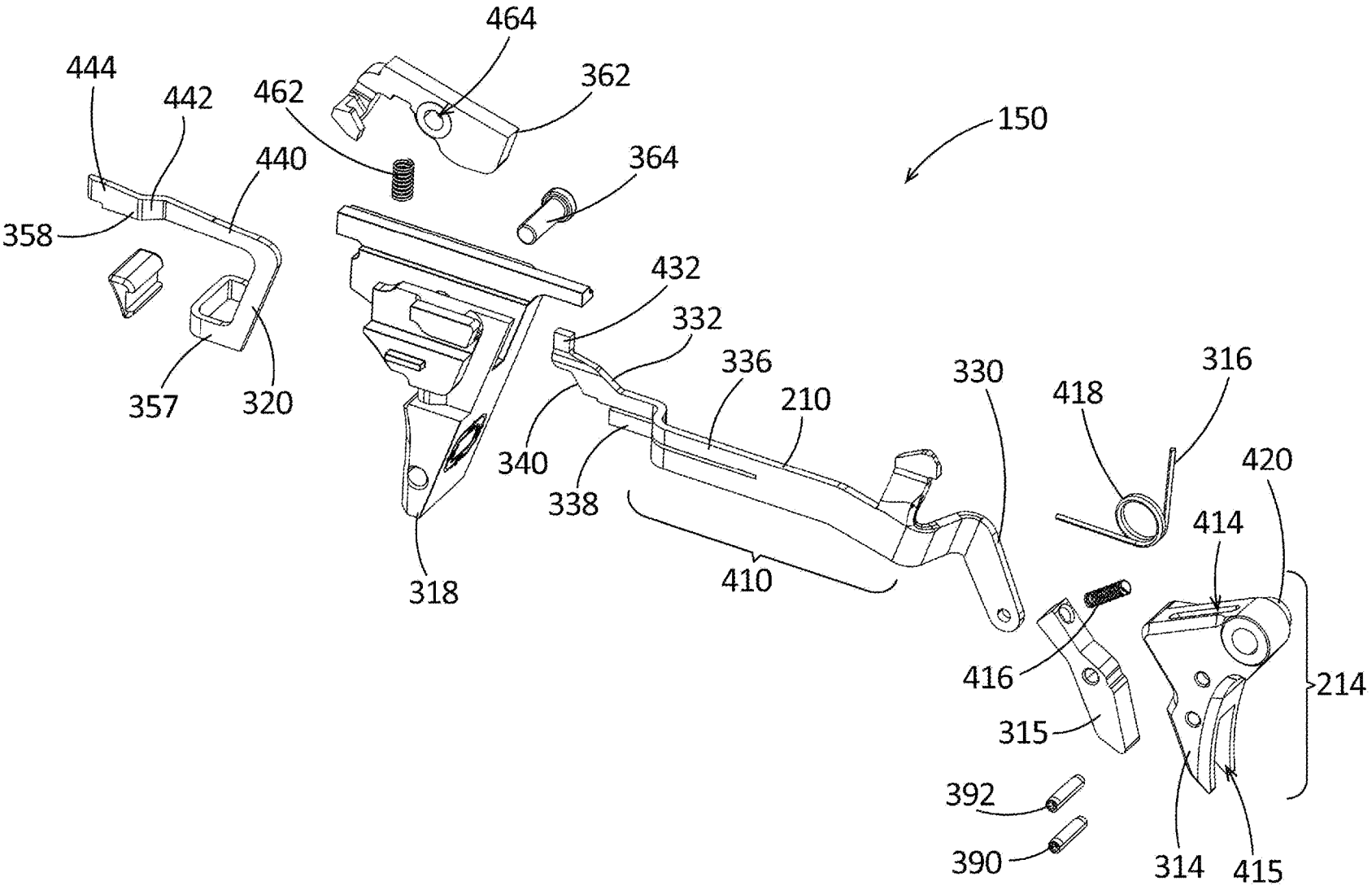
FIG. 4 is a perspective exploded view of the trigger assembly of FIG. 1.

FIG. 4 is a perspective exploded view of the trigger assembly 150 of FIG. 1.

The trigger bar 210 can define a central bent portion 410 positioned between the front end 330 and the rear end 332. The central bent portion 410 can bow outwards from the ends 330, 332 in a lateral direction towards the right side 130 of the firearm 100. The central bent portion 410 provide clearance for the magazine 199 of the firearm 100 (shown in FIG. 1).

The trigger body 314 can define an upper slot 414 and a lower slot 415. The upper slot 414 can receive the front end 330 of the trigger bar 210, which can be secured by the pin 392 as described above. The lower slot 415 can receive the trigger safety blade 315, which can be secured by the pin 390 as described above. The trigger 214 can further comprise a blade safety biasing member 416, which can fit between the trigger blade safety 315 and the trigger body 314. The blade safety biasing member 416 can bias the trigger safety blade 315 towards the safe position discussed above with respect to FIG. 2.

The trigger body 314 can define a trigger biasing member boss 420. In the present aspect a coil 418 of the trigger biasing member 316 can fit over the trigger biasing member boss 420. The trigger hinge pin 152 (shown in FIG. 1) can extend through the trigger biasing member boss 420 and through the coil 418 when the trigger assembly 150 is installed into the frame 102 (shown in FIG. 1).

The sear 362 can define a sear pin hole 464, which can receive the sear pin 364. The trigger assembly 150 can further comprise the sear biasing member 462. The sear biasing member 462 can be received within the trigger housing 318. The sear biasing member 462 can bias the sear 362 to rotate about the sear pin 364 towards an engagement sear position. In the engagement sear position, the sear 362 can be positioned to engage the sear engagement lug 262 (shown in FIG. 2) of the striker 254 (shown in FIG. 2) to secure the striker 254 in the cocked position.

The lower arm 357 of the disconnector 320 can be shaped to wrap around a rear surface of the trigger body 314. The upper arm 358 of the disconnector 320 can define a front portion 440, a rear portion 444, and an angled portion 442. The front portion 440 and the rear portion 444 can be substantially parallel to one another. The angled portion 442 can extend laterally outwards towards the right side 130 of the firearm 100 (shown in FIG. 1), and the rear portion 444 can be positioned closer to the right side 130 than the front portion 440.

The trigger bar 210 can define a disconnector engagement tab 432 at the rear end 332. The disconnector engagement tab 432 can be positioned above the sear engagement surface 340. The disconnector engagement tab 432 can extend upwards from the upper leg 336. The disconnector engagement tab 432 can engage with the rear portion 444 of the upper arm 358 of the disconnector 320.

The upper leg 336 of the trigger bar 210 is shown in the default leg shape. In the default leg shape, the upper leg 336 can be positioned directly above and in alignment with the lower leg 338.

Figure 5:
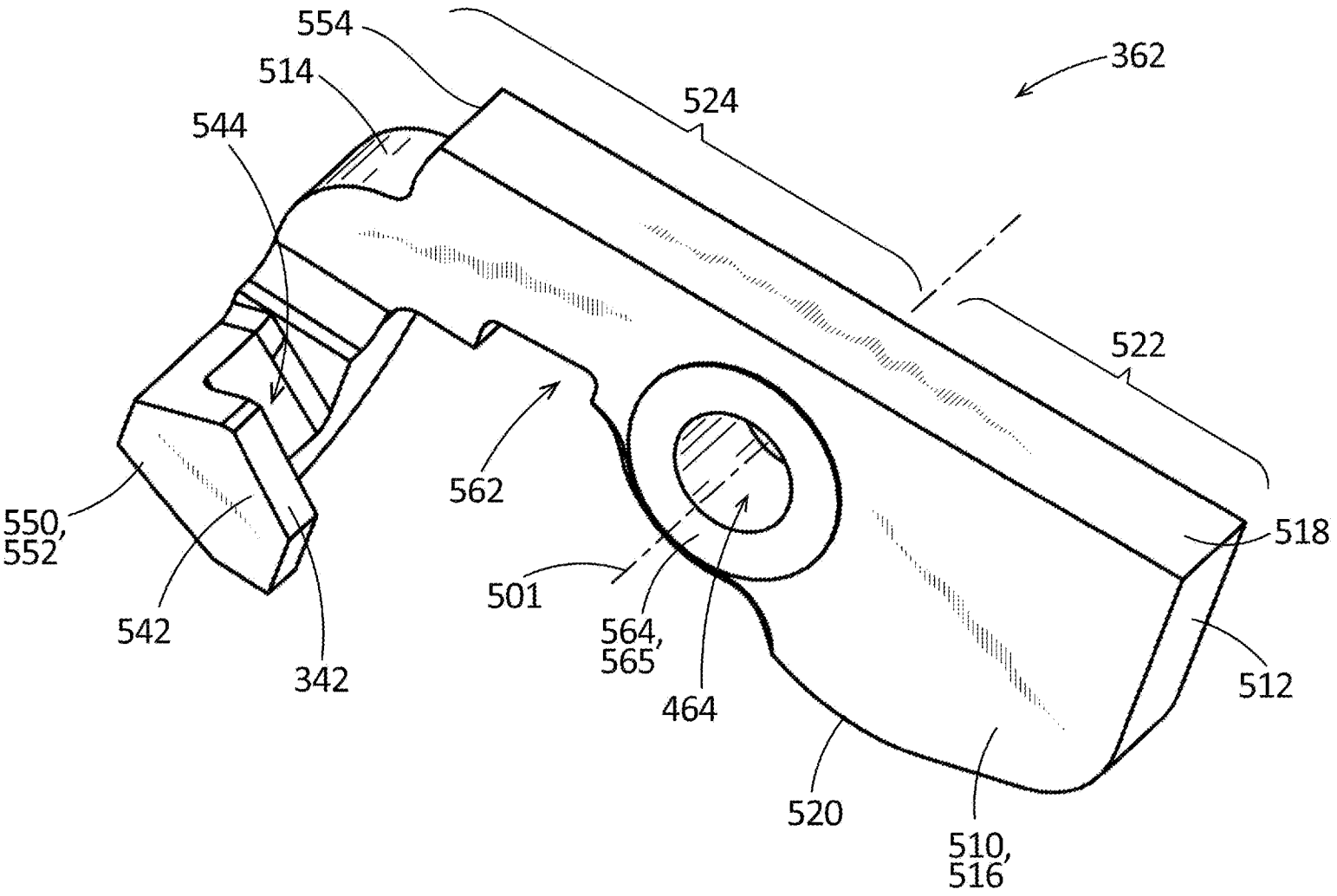
FIG. 5 is a perspective view of a sear of the trigger assembly of FIG. 1.

FIG. 5 is a perspective view of the sear 362 of the trigger assembly 150 of FIG. 1.

The sear 362 can define a main sear body 510 and a trigger bar engagement arm 550. The main sear body 510 can define a front end 512 and a rear end 514. The front end 512 can be defined opposite from the rear end 514. The main sear body 510 can define a right side 516 and a left side 616 (shown in FIG. 6). The main sear body 510 can define a top side 518 and a bottom side 520.

The sear pin hole 464 can extend through the main sear body 510 from the right side 516 to the left side 616. The sear pin hole 464 can define a sear axis 501 extending in the lateral direction, and the sear 362 can be configured to rotate about the sear axis 501. As demonstrated by the right side 516, each of the sides 516, 616 can define a raised boss 564 extending around the sear pin hole 464. Each of the raised bosses 564 can define a smooth bearing surface 565. The bearing surfaces 565 can facilitate rotational movement between the sear 362 and adjacent structures, such as the trigger housing 318 (shown in FIG. 3).

The sear axis 501 can extend through a center of mass of the sear 362, and the sear 362 can be neutrally weighted about the sear axis 501. This can be advantageous because if the firearm 100 (shown in FIG. 1) is exposed to an external force, such as from the impact of being dropped on a hard surface, the sear 362 will not be biased to rotate about the sear axis 501 on the sear pin 364 as a result of this force, thereby preventing the sear 362 from inadvertently releasing the striker 254 (shown in FIG. 2) due to impact.

The main sear body 510 can define a front portion 522 between the front end 512 and the sear axis 501, and the main sear body 510 can define a rear portion 524 between the rear end 514 and the sear axis 501.

The rear portion 524 can define a spring notch 562. The spring notch 562 can be positioned along the bottom side 520. The spring notch 562 can be configured to receive the sear biasing member 462 (shown in FIG. 4). The sear biasing member 462 can bias the sear 362 to rotate about the sear axis 501 in a clockwise direction when the sear 362 is viewed from the right side 516.

The rear portion 524 can define a striker engagement shoulder 554. The striker engagement shoulder 554 can be defined along the top side 518. The striker engagement shoulder 554 can be configured to selectively engage with the sear engagement lug 262 of the striker 254 to maintain the striker 254 in the cocked position.

The trigger bar engagement arm 550 can extend laterally outward from the main sear body 510. In some aspects, the trigger bar engagement arm 550 can extend outward from the main sear body 510 in a direction substantially parallel to the sear axis 501. In the present aspect, the trigger bar engagement arm 550 can extend outwards from the rear portion 524 and/or the rear end 514 of the main sear body 510. In the present aspect, the trigger bar engagement arm 550 can extend laterally outwards from the right side 516 of the main sear body 510. The trigger bar engagement arm 550 can define an end 552 positioned opposite from the main sear body 510.

The end 552 of the trigger bar engagement arm 550 can define a raised rib 542. The raised rib 542 can define the trigger bar engagement surface 342. The raised rib 542 can extend upwards and forwards from the end 552. The trigger bar engagement arm 550 can define a reset notch 544 positioned between the end 552 and the main sear body 510. In the present aspect, the reset notch 544 can be defined between the raised rib 542 and the right side 516 of the main sear body 510.

Figure 6:
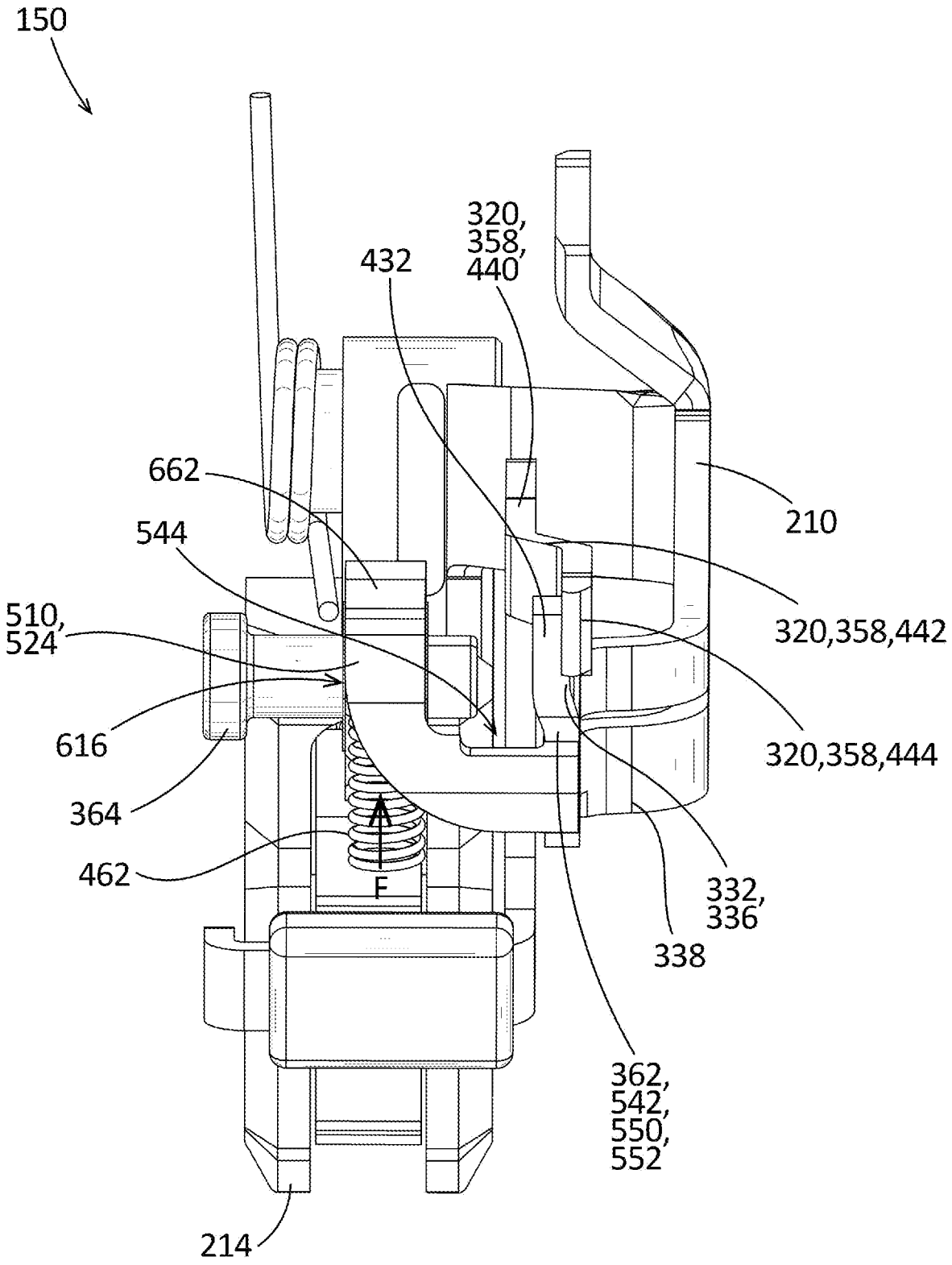
FIG. 6 is a rear view of the trigger assembly of FIG. 1 with a trigger housing of the trigger assembly hidden from view.

FIG. 6 is a rear view of the trigger assembly 150 of FIG. 1 with the trigger housing 318 hidden from view. In the present view, the trigger 214 and the trigger bar 210 in their respective forward positions. The upper leg 336 and the upper arm 358 can be in their respective default shapes, in which the front portion 440 and the rear portion 444 of the upper arm 358 and a portion of the upper leg 336 positioned at the rear end 332 of the trigger bar 210 can each be oriented substantially parallel to the forward direction 200 and/or the barrel axis 201 (forward direction 200 and barrel axis 201 shown in FIG. 2). In default leg shape of the upper leg 336, the upper leg 336 can be positioned directly over the lower leg 338, and the rear end 332 of the upper leg 336 of the trigger bar 210 can be laterally aligned with the raised rib 542 at the end 552 of the trigger bar engagement arm 550 of the sear 362.

The front portion 440 of the disconnector 320 can be laterally aligned to the left of the disconnector engagement tab 432 of the upper leg 336. The angled portion 442 of the disconnector 320 can extend laterally to the right to position the rear portion 444 of the disconnector 320 to the right of the disconnector engagement tab 432. The disconnector engagement tab 432 and the rear portion 444 of the disconnector 320 can be positioned in facing engagement.

The sear biasing member 462 can exert an upward force F on the rear portion 524 of the main sear body 510, which can bias the sear 362 to rotate about the sear pin 364 to the engagement sear position shown. In the engagement sear position, a striker engagement surface 662 of the sear 362 can engage the sear engagement lug 262 of the striker 254 to secure the striker 254 in the cocked position, as shown in FIG. 7.

Figure 7:
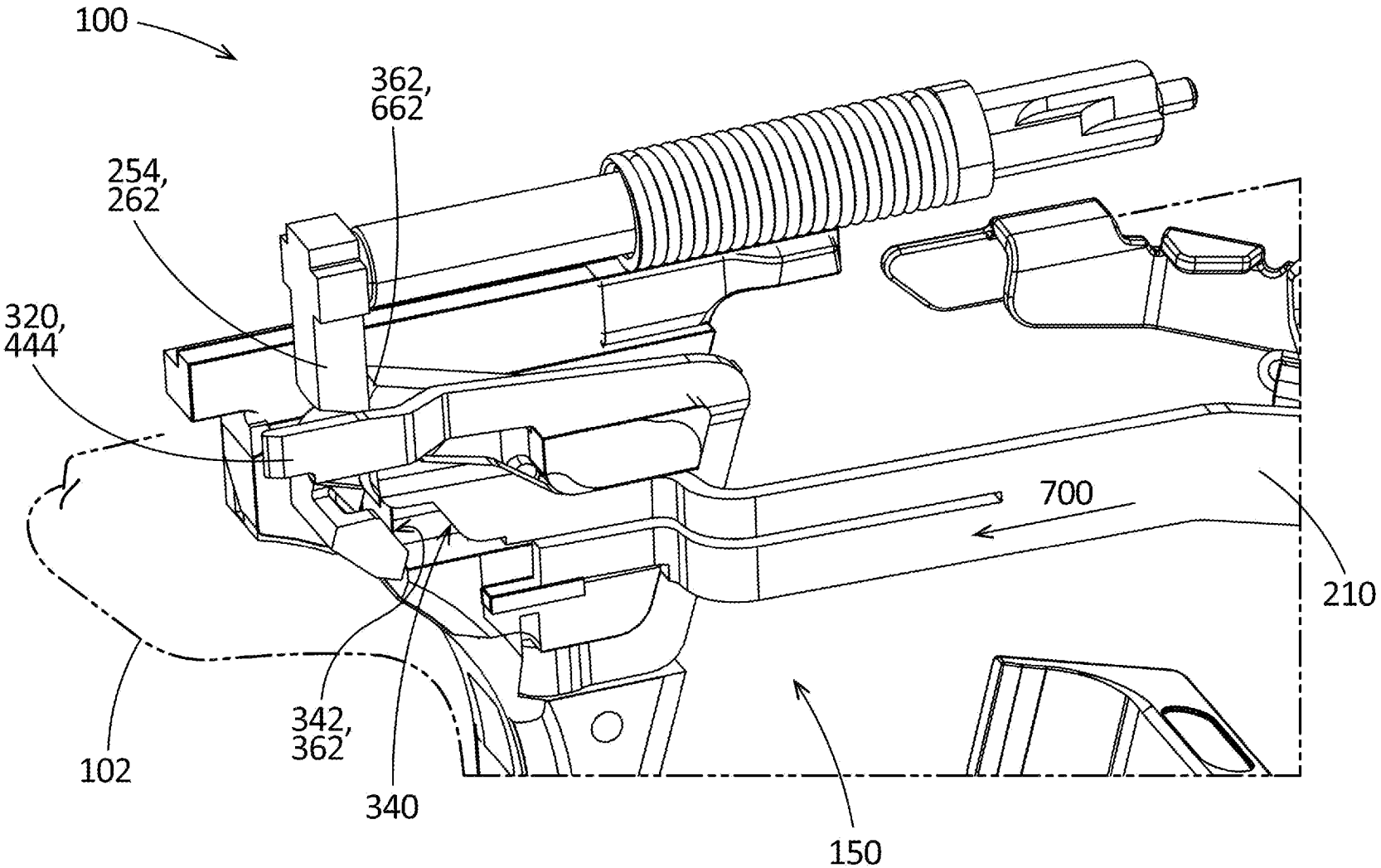
FIG. 7 is a right-side perspective view of the firearm of FIG. 1 with the slide removed from view and a frame of the firearm illustrated in transparency.

FIG. 7 is a right-side perspective view of the firearm 100 of FIG. 1 with the slide 104 (shown in FIG. 1) removed from view and the frame 102 illustrated in transparency. The trigger bar 210 is shown in the forward position. In the forward position, the sear engagement surface 340 of the trigger bar 210 can be spaced forward and apart from the trigger bar engagement surface 342 of the sear 362.

Figure 8:
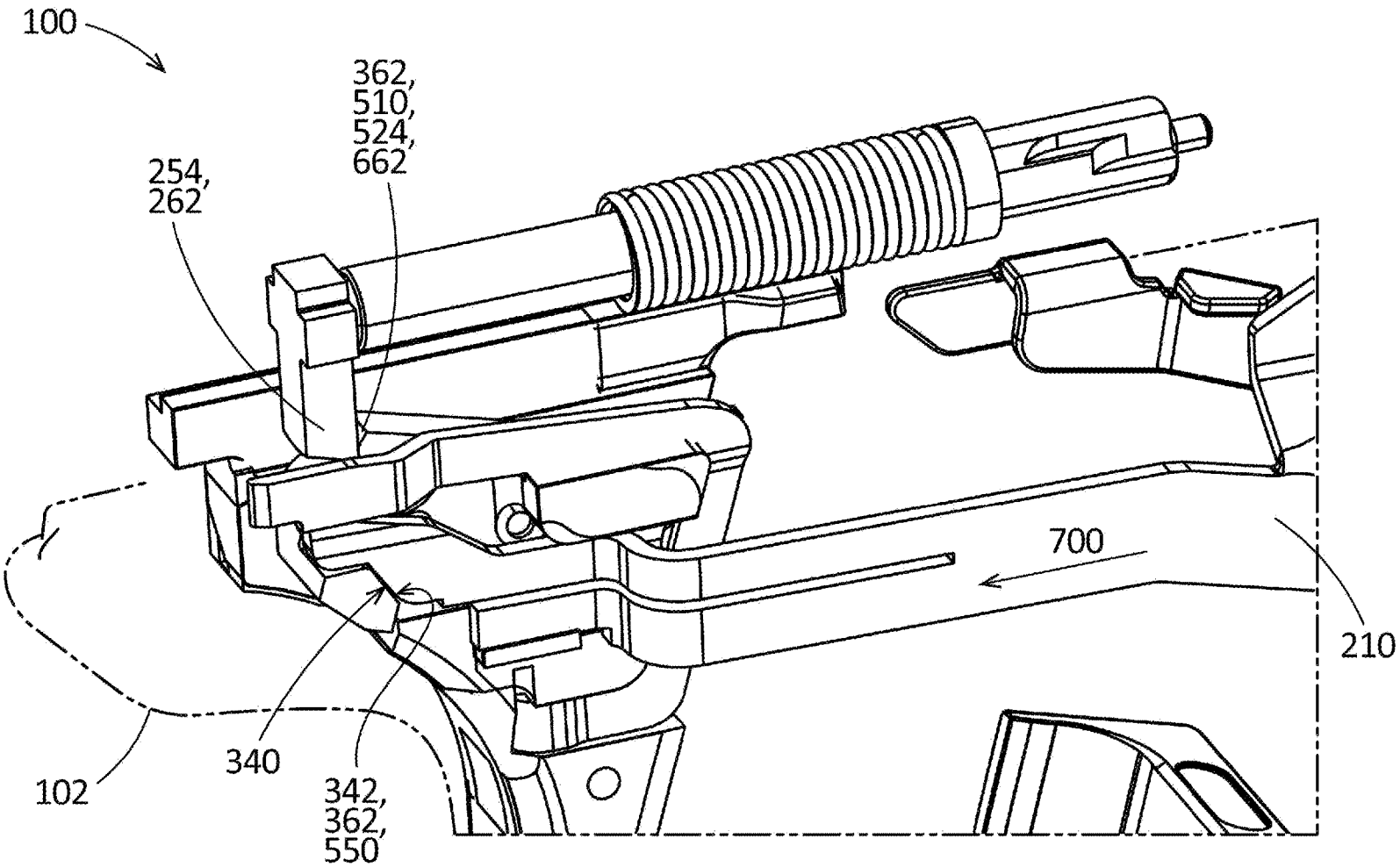
FIG. 8 is a right-side perspective view of the firearm of FIG. 1 with the slide removed from view and the frame illustrated in transparency.

As similarly discussed above, pressing the trigger 214 (shown in FIG. 2) can cause the trigger 214 to pivot and the trigger bar 210 to move rearward in a rearward direction 700 to the intermediate position of the trigger 214, shown in FIG. 8, wherein the sear engagement surface 340 of the trigger bar 210 can initially contact the trigger bar engagement surface 342 of the sear 362. During rearward travel in the rearward direction 700, the disconnector engagement tab 432 (shown in FIG. 6) of the trigger bar 210 can slide along the rear portion 444 of the disconnector 320 while maintaining facing engagement with the disconnector 320.

FIG. 8 is a right-side perspective view of the firearm 100 of FIG. 1 with the slide 104 (shown in FIG. 1) removed from view and the frame 102 illustrated in transparency. The trigger bar 210 is shown in the intermediate position. In the intermediate position, the sear engagement surface 340 of the trigger bar 210 can be in facing engagement with the trigger bar engagement surface 342 of the sear 362, and the sear 362 remains in the engagement sear position wherein the striker engagement surface 662 of the sear 362 can engage the sear engagement lug 262 of the striker 254 to retain the striker 254 in the cocked position, as shown.

Figure 9:
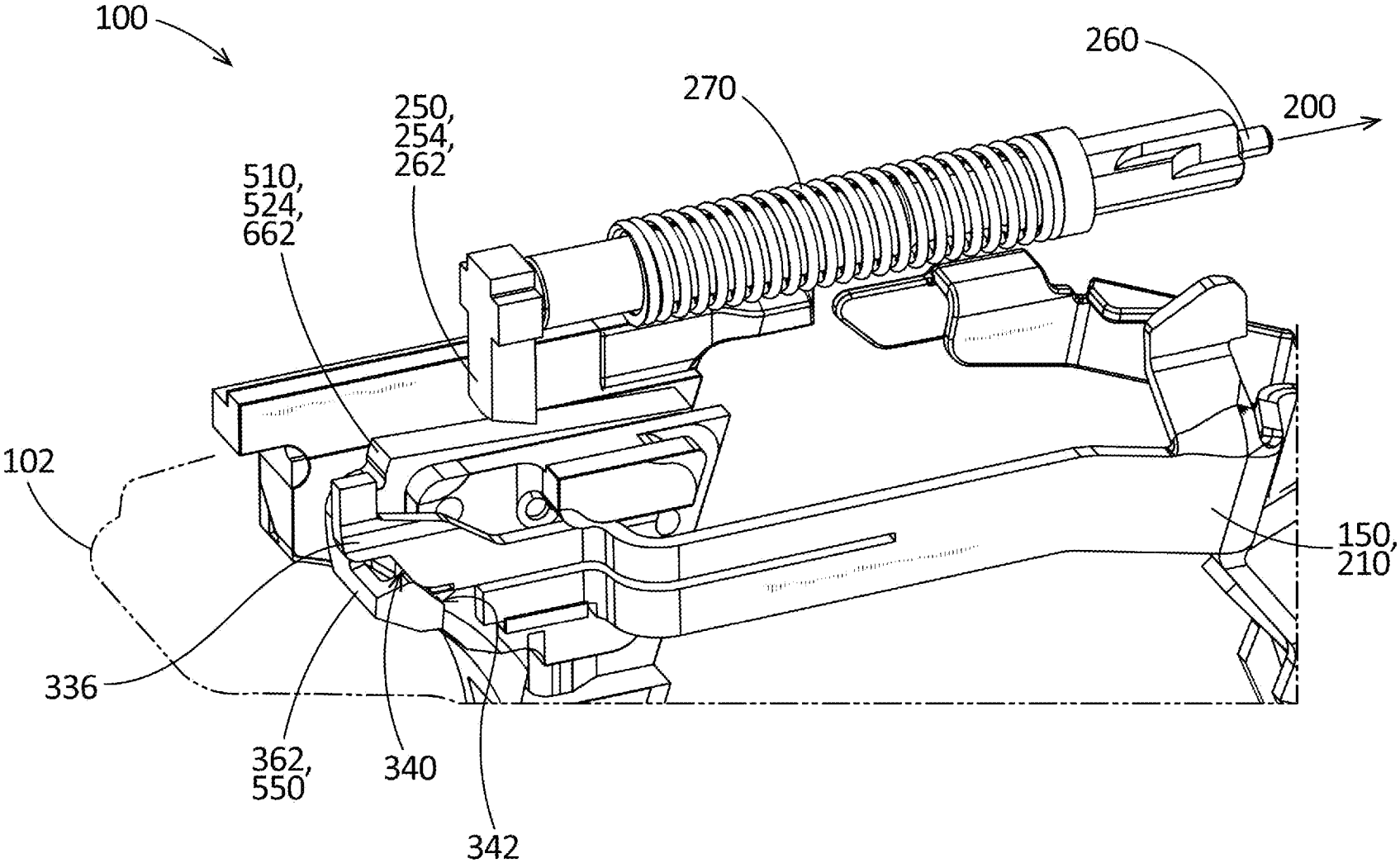
FIG. 9 is a right-side perspective view of the firearm of FIG. 1 with the slide and a disconnector of the trigger assembly removed from view and the frame illustrated in transparency.

With the trigger bar 210 in the intermediate position, further pressing the trigger 214 (shown in FIG. 2) can cause the trigger bar 210 to move further rearward in the rearward direction 700 towards the rearward position (shown in FIG. 9). As the trigger bar 210 moves from the intermediate position to the rearward position, the angled engagement between the sear engagement surface 340 of the trigger bar 210 and the trigger bar engagement surface 342 of the sear 362 can cause the sear 362 to rotate about the sear pin 364 (shown in FIG. 3), which in turn can cause the trigger bar engagement arm 550 and the rear portion 524 of the main sear body 510 to rotate downwards to a disengaged sear position of the sear 362, as shown in FIG. 9.

FIG. 9 is a right-side perspective view of the firearm 100 of FIG. 1 with the slide 104 (shown in FIG. 1) and the disconnector 320 (shown in FIG. 3) removed from view and the frame 102 illustrated in transparency. The trigger bar 210 of the trigger assembly 150 is shown in the rearward position with the upper leg 336 in the default leg shape. The sear 362 is shown in the disengaged sear position.

As the trigger bar engagement arm 550 and the rear portion 524 of the main sear body 510 rotate downwards to the disengaged sear position of the sear 362, the striker engagement surface 662 of the sear 362 can slide downwards and disengage from the sear engagement lug 262 of the striker 254, thereby releasing the striker 254 and placing the fire control mechanism 250 in a fired configuration. In the fired configuration of the fire control mechanism 250, the striker 254 has been released by the sear 362 and travelled in the forward direction 200 to a striking position under force provided by the striker biasing member 270. In the striking position, the firing pin 260 of the striker 254 can strike and detonate a primer of a cartridge (not shown) positioned within the barrel 106 (shown in FIG. 1), thereby causing the cartridge to fire.

In the fired configuration, the trigger bar 210 is in the rearward position with the upper leg 336 in the default leg shape, wherein the sear engagement surface 340 of the trigger bar 210 remains in contact with the trigger bar engagement surface 342 of the sear 362. Through contact between the sear engagement surface 340 and the trigger bar engagement surface 342, the upper leg 336 can hold the sear 362 in the disengaged sear position by overcoming the upward force F (shown in FIG. 6) exerted on the rear portion 524 of the sear 362 by the sear biasing member 462 (shown in FIG. 4). The firearm 100 cannot fire again until the fire control mechanism 250 is reset to the cocked configuration as described below with respect to FIGS. 11-14.

Figure 10:
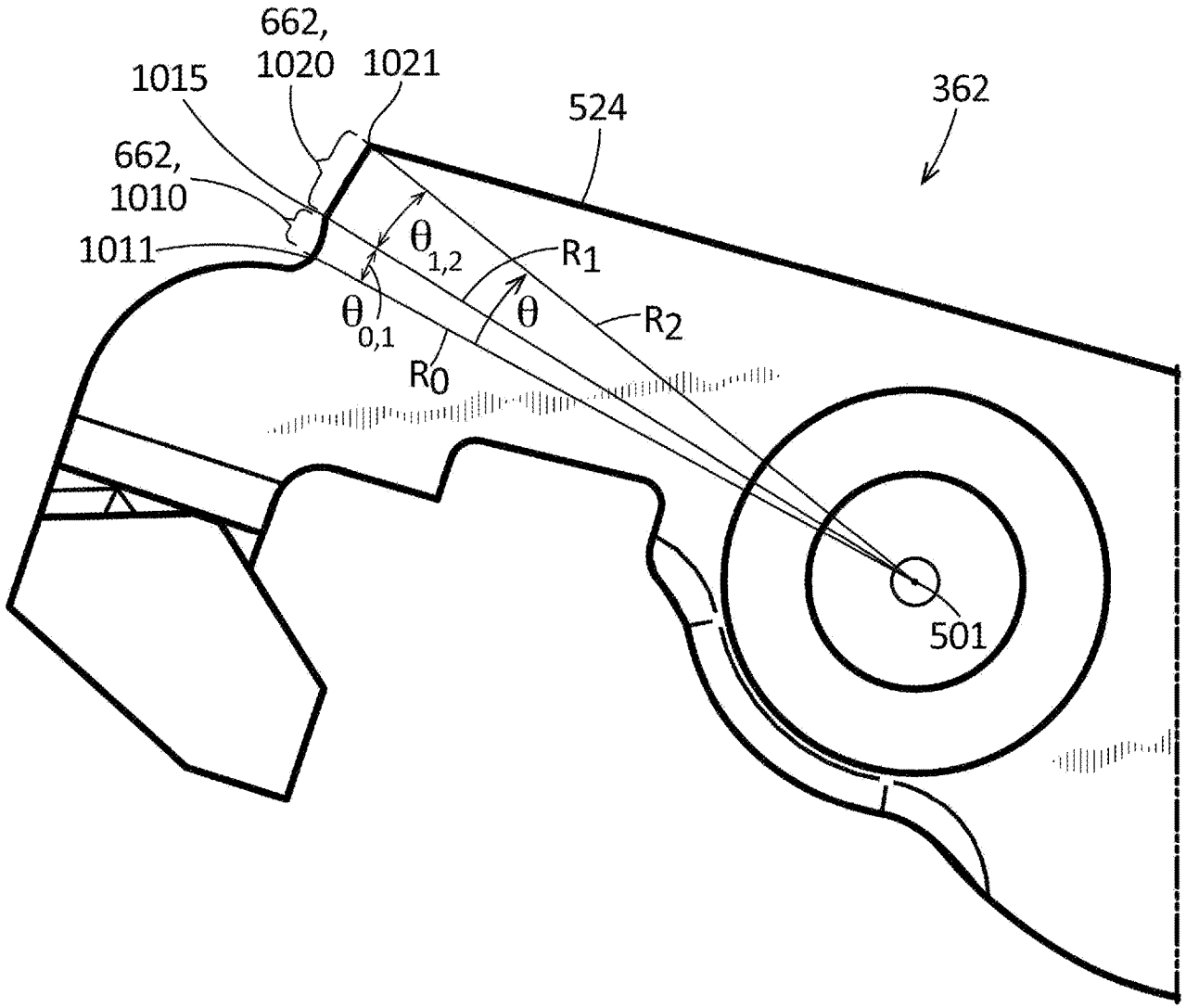
FIG. 10 is a right-side detail view of a rear portion of the sear of the trigger assembly of FIG. 1.

FIG. 10 is a right-side detail view of the rear portion 524 of the sear 362. The shape of the striker engagement surface 662 can be specifically shaped to provide a crisp trigger break when pulling the trigger 214 (shown in FIG. 2) to reposition the trigger bar 210 (shown in FIG. 2) from the intermediate position to the rearward position, thereby firing the firearm 100 (shown in FIG. 1).

The striker engagement surface 662 can define a primary engagement region 1010 and a secondary engagement region 1020. The striker engagement surface 662 can define a transition point 1015 between the primary engagement region 1010 and the secondary engagement region 1020. The primary engagement region 1010 can extend between an initial engagement point 1011 and the transition point 1015. The secondary engagement region 1020 can extend between the transition point 1015 and a final engagement point 1021.

A radius R can be measured between the striker engagement surface 662 and the sear axis 501 (illustrated coming out of the page). Radius $R_0$ can correspond to the radius measurement at the initial engagement point 1011. Radius $R_1$ can correspond to the radius measurement at the transition point 1015. Radius $R_2$ can correspond to the radius measurement at the final engagement point 1021. An angle θ can be measured in a clockwise direction from radius $R_0$ (i.e. value of angle θ at radius $R_0$ is zero, and the value of angle θ increases towards radius $R_1$ and then radius $R_2$). In some aspects, the value of the angle θ between radius $R_0$ and radius $R_1$ ($\theta_{0,1}$) can be less than the value of the angle θ between radius $R_1$ and radius $R_2$ ($\theta_{1,2}$), such that the primary engagement region 1010 can be smaller than the secondary engagement region 1020. In some aspects, the angle θ between radius $R_0$ and radius $R_1$ ($\theta_{0,1}$) can be substantially the same as the angle θ between radius $R_1$ and radius $R_2$ ($\theta_{1,2}$). In some aspects, the value of the angle θ between radius $R_0$ and radius $R_1$ ($\theta_{0,1}$) can be larger than the value of the angle θ between radius $R_1$ and radius $R_2$ ($\theta_{1,2}$), such that the primary engagement region 1010 can be larger than the secondary engagement region 1020.

The radius R can increase in length over the primary engagement region 1010 as the angle θ increases from the initial engagement point 1011 to the transition point 1015 (i.e. Radius $R_1$>Radius $R_0$). In some aspects, the rate at which the radius R increases from the initial engagement point 1011 to the transition point 1015 can increase or remain constant. For example, if radius R is a function of angle θ (R(θ)), the first derivative of the function (R'(θ)) can have a positive value for the primary engagement region 1010 signifying that the radius R is increasing as angle θ increases, and the second derivative of the function (R"(θ)) can be greater than or equal to zero, signifying that as the angle θ increases, the radius R increases at an increasing or constant rate.

The radius R can increase in length over the secondary engagement region 1020 as the angle θ increases from the transition point 1015 to the final engagement point 1021 (i.e. Radius $R_2$>Radius $R_1$). However, the rate at which the radius R increases from the transition point 1015 to the final engagement point 1021 can decrease. Similar to the primary engagement region 1010, if radius R is a function of angle θ (R(θ)), the first derivative of the function (R'(θ)) can have a positive value for the secondary engagement region 1020 signifying that the radius R is increasing as angle θ increases, but the second derivative of the function (R"(θ)) can have a negative value signifying that as the angle θ increases, the radius R increases at a decreasing rate.

With the trigger bar 210 in the forward or intermediate positions, contact between the sear engagement lug 262 (shown in FIG. 2) and the striker engagement surface 662 can occur in the primary engagement region 1010 between the initial engagement point 1011 and the transition point 1015. In some aspects, the contacting portions of the sear engagement lug 262 and the primary engagement region 1010 can be almost or substantially parallel to one another, such that the force exerted on the sear engagement lug 262 can be substantially parallel to the forward direction 200 (shown in FIG. 2). Preferably, contact between the sear engagement lug 262 and the striker engagement surface 662 can occur at or proximate to the transition point 1015.

As the trigger 214 (shown in FIG. 2) is pulled and the trigger assembly 150 transitions from the intermediate position towards the rearward position, the trigger 214 can "break" and contact between the sear engagement lug 262 and the striker engagement surface 662 can migrate from the primary engagement region 1010 into and across the secondary engagement region 1020 towards the final engagement point 1021. Once the sear engagement lug 262 slips off the final engagement point 1021, the striker 254 (shown in FIG. 2) can be released to travel forwards as described above.

However, because the radius R increases from the initial engagement point 1011 to the final engagement point 1021, the striker 254 subtly moves rearward and subtly further compresses the striker biasing member 270 (shown in FIG. 2), thereby requiring more energy to be put into the striker biasing member 270 to successfully discharge the firearm 100. This is sometimes referred to as "positive engagement," and can help prevent accidental disengagement between the sear 362 and the striker 254, such as due to dropping the firearm 100, because the striker biasing member 270 subtly biases the sear 362 to rotate about the sear axis 501 towards the engagement sear position (clockwise with respect to the present viewing angle).

Large regions of positive sear engagement can be desirable for safety purposes but often result in large amounts of trigger creep, wherein the shooter feels the sensation that the trigger is slowly dragging through the breaking point before a firearm discharges rather than a quick, crisp break as the trigger is pulled.

In the some aspects, the first derivative of the function ($R'(\theta)$) can substantially decrease in value (while remaining positive) at the transition point 1015. The maximum pull force required when pulling the trigger 214 to actuate the fire control mechanism 250 can occur when the sear engagement lug 262 is sliding over the transition point 1015. While the positive engagement provided between the sear engagement lug 262 and the secondary engagement region 1020 of the striker engagement surface 662 still require more energy be put into the trigger assembly 150 through the form of work performed by the user's trigger finger, the decrease in trigger pull weight the secondary engagement region 1020 after peaking at the transition point 1015 results in the user's trigger finger naturally following through the remainder of the engagement provided by the secondary engagement region 1020. This arrangement can provide the sensation to the shooter that the trigger assembly 150 "breaks" the shot once the sear engagement lug 262 slides over the transition point 1015 when in fact the striker 254 is not released until after the sear engagement lug 262 slides off the final engagement point 1021. Because the primary engagement region 1010 is relatively small compared to the secondary engagement region 1020 and initial contact preferably occurs at or near the transition point 1015, this arrangement provides the sensation of a short, crisp break in the trigger pull while maintaining a large positive engagement region between the sear 362 and the striker 254.

One method of changing the pull weight profile of the trigger assembly 150 is to utilize various aspects of the sear 362 and the trigger bar 210 (shown in FIG. 2) with sear engagement surface 340 and the trigger bar engagement surface 342 provided at different complimentary angles. The more upright the angle of these surfaces 340, 342 (i.e. the closer to perpendicular to the forward direction 200), the heavier the peak trigger pull weight will be. The closer to horizontal the angle of these surfaces 340, 342 (i.e. closer to parallel to the forward direction 200), the lighter the peak trigger pull weight will be.

Pull weight profile of the trigger assembly 150 can also be adjusted via replacement of the trigger biasing member 316 (shown in FIG. 3) and the sear biasing member 462 (shown in FIG. 4). The trigger biasing member 316 can resist travel of the trigger bar 210 in the rearward direction 700 (shown in FIG. 7) from the forward trigger bar position to the rearward trigger bar position, and the trigger biasing member 316 can reset the trigger bar 210 from the rearward trigger bar position to the intermediate trigger bar position, the forward trigger bar position, or a position therebetween. The sear biasing member 462 can resist rotation of the sear 262 (shown in FIG. 2) from the engagement sear position to the disengaged sear position, which in turn can resist rearward movement of the trigger bar 210 from the intermediate trigger bar position to the rearward trigger bar position.

By replacing the trigger biasing member 316 and the sear biasing member 462 with lighter or heavier springs, the pull weight profile can be adjusted to provide a different feel for the user without compromising function of the firearm 100. For example, a user desiring a very light trigger pull, the trigger assembly 150 can be fit with both a lightweight trigger biasing member 316 and a lightweight sear biasing member 462, which provides both a light take up from the forward trigger bar position to the intermediate trigger bar position and a light break from the intermediate trigger bar position to the rearward trigger bar position.

For someone desiring a heavy trigger pull, the trigger assembly 150 can be fit with both a heavyweight trigger biasing member 316 and a heavyweight sear biasing member 462, which provides both a heavy take up from the forward trigger bar position to the intermediate trigger bar position and a heavy break from the intermediate trigger bar position to the rearward trigger bar position.

For someone desiring a two-stage trigger pull profile, the trigger assembly 150 can be fit with a lightweight trigger biasing member 316 and a heavyweight sear biasing member 462, which provides a light take up from the forward trigger bar position to the intermediate trigger bar position and a well-defined break from the intermediate trigger bar position to the rearward trigger bar position.

For someone desiring a trigger pull profile more similar in feeling to a traditional double-action, the trigger assembly 150 can be fit with a heavyweight trigger biasing member 316 and a lightweight sear biasing member 462, which provides a relatively consistent pull from the forward trigger bar position to the rearward trigger bar position and minimizes the difference in pull weight between the take-up from the forward trigger bar position to the intermediate trigger bar position and the break between the intermediate trigger bar position and the rearward trigger bar position.

These examples for adjusting the pull weight profile are merely exemplary and should not be viewed as limiting. Each of the trigger biasing member 316 and the sear biasing member 462 can be provided in various spring rates and are not limited to the lightweight and heavyweight examples referenced above.

FIGS. 11-14 demonstrate a method by which the fire control mechanism 250 can reset following the discharge of the firearm 100 from the fired configuration the cocked configuration.

Figure 11:
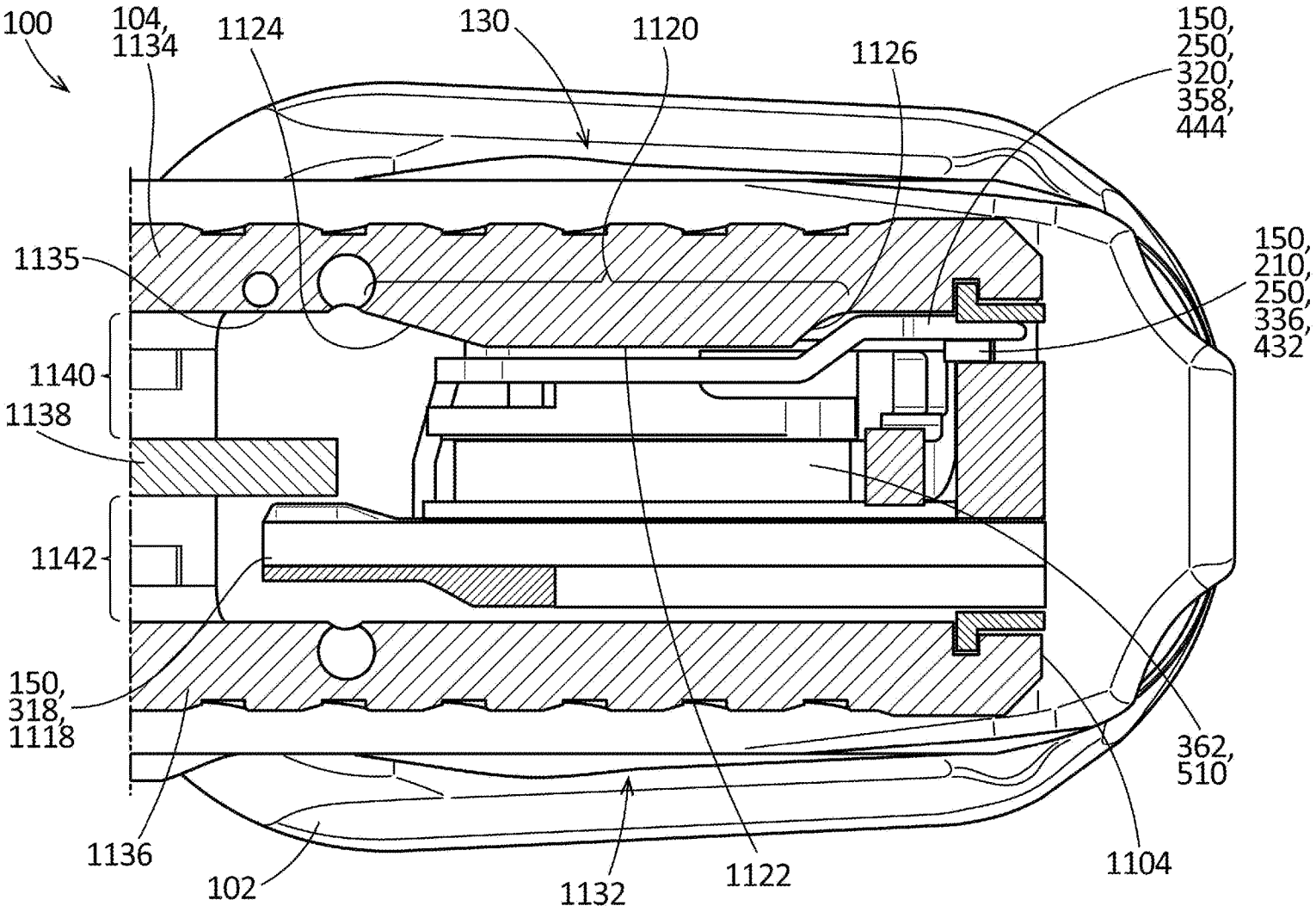
FIG. 11 is a detailed cross-sectional view of the firearm of FIG. 1 taken along Line 11-11 shown in FIG. 1.

FIG. 11 is a detailed cross-sectional view of the firearm 100 taken along Line 11-11 shown in FIG. 1. The trigger assembly 150 is shown with the trigger bar 210 in the rearward position and the upper leg 336 and the upper arm 358 each positioned in their respective default shapes.

The slide 104 can define a right slide rail 1134, a left slide rail 1136, and a center rib 1138. The slide rails 1134, 1136 can reciprocate on corresponding rails defined by the frame 102 between a forward position of the slide (shown in FIGS. 1 and 11) and a rearward position of the slide 104 (not shown).

The right slide rail 1134 can be positioned at or near the right side 130 of the firearm 100. The left side rail 1136 positioned at or near the left side 1132 of the firearm 100. The center rib 1138 can be laterally aligned with the main sear body 510 of the sear 362.

The center rib 1138 can be defined between the right slide rail 1134 and the left slide rail 1136. A right slot 1140 can be defined between the right slide rail 1134 and the center rib 1138. A left slot 1142 can be defined between the left slide rail 1136 and the center rib 1138.

The right slot 1140 can provide clearance in the slide 104 for the disconnector 320 and the trigger bar 210 to permit the slide 104 to reciprocate on the frame 102. Specifically, the right slot 1140 can provide clearance for the upper arm 358 of the disconnector 320 and the disconnector engagement tab 432 of the trigger bar 210.

The left slot 1142 can provide clearance in the slide 104 for an ejector 1118 defined by the trigger housing 318. The ejector 1118 can be configured to strike the spent case of a fired cartridge (not shown) when the slide 104 travels rearward on the frame 102, thereby ejecting the case from the firearm 100.

The right slide rail 1134 can define a disconnector ramp 1120. The disconnector ramp 1120 can extend laterally into the right slot 1140. Specifically, the disconnector ramp 1120 can extend laterally inward from an inner surface 1135 of the right slide rail 1134 toward the center rib 1138 and/or the left slide rail 1136 in the present aspect. The disconnector ramp 1120 can define an inner surface 1122, a front transition contour 1124, and a rear transition contour 1126. The inner surface 1122 can be laterally positioned between the inner surface 1135 of the right slide rail 1134 and the left slide rail 1136. The front transition contour 1124 can extend at least partially between the inner surface 1135 of the right slide rail 1134 to the inner surface 1122 of the disconnector ramp 1120. The rear transition contour 1126 can extend at least partially between the inner surface 1135 of the right slide rail 1134 to the inner surface 1122 of the disconnector ramp 1120. In various aspects, either or both of the transition contours 1124, 1126 can be planar, concave, convex, a combination of one or more such surfaces, for example and without limitation. In the present aspect, the front transition contour 1124 can comprise a planar, angled surface. In the present aspect, the rear transition contour 1126 can comprise a concave surface.

The rear portion 444 of the disconnector 320 can be positioned between the rear transition contour 1126 and a rear end 1104 of the slide 104 when the slide 104 is in the forward position. With the upper arm 358 of the disconnector 320 in the default arm shape, the rear portion 444 can contact the inner surface 1135 of the right slide rail 1134, and the rear portion 444 can be laterally positioned between the inner surface 1135 of the right slide rail 1134 and the inner surface 1122 of the disconnector ramp 1120.

The rear portion 444 of the disconnector 320 can be laterally positioned between the disconnector engagement tab 432 of the upper leg 336 of the trigger bar 210 and the right slide rail 1134. As similarly discussed above, the disconnector engagement tab 432 can contact and slide along the rear portion 444 of the disconnector 320 as the trigger bar 210 moves between the forward position, the intermediate position, and the rearward position.

Figure 12:
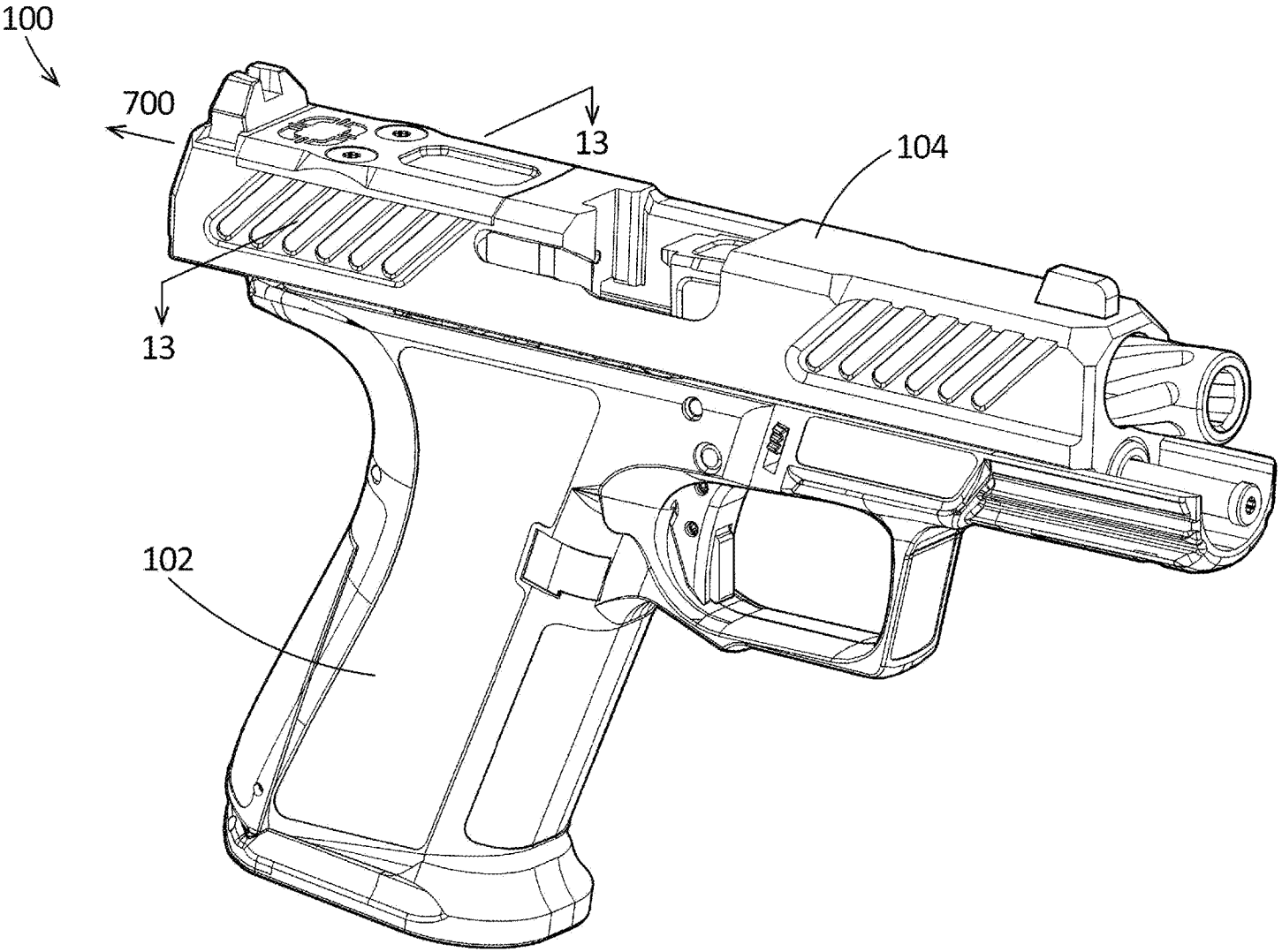
FIG. 12 is a right-side perspective view of the firearm of FIG. 1 with the slide partially retracted in a rearward direction.

As demonstrated in FIG. 12, once the firearm 100 has fired a cartridge, the slide 104 can travel in the rearward direction 700 relative to the frame 102 towards the rearward position of the slide 104. As the slide 104 moves rearward, the rear transition contour 1126 can engage with the angled portion 442 of the disconnector 320 to laterally deflect the upper arm 358 of the disconnector 320 and the upper leg 336 of the trigger bar 210 from their respective default shapes to their respective disconnected shapes, as shown in FIG. 13 and FIG. 14.

Figure 13:
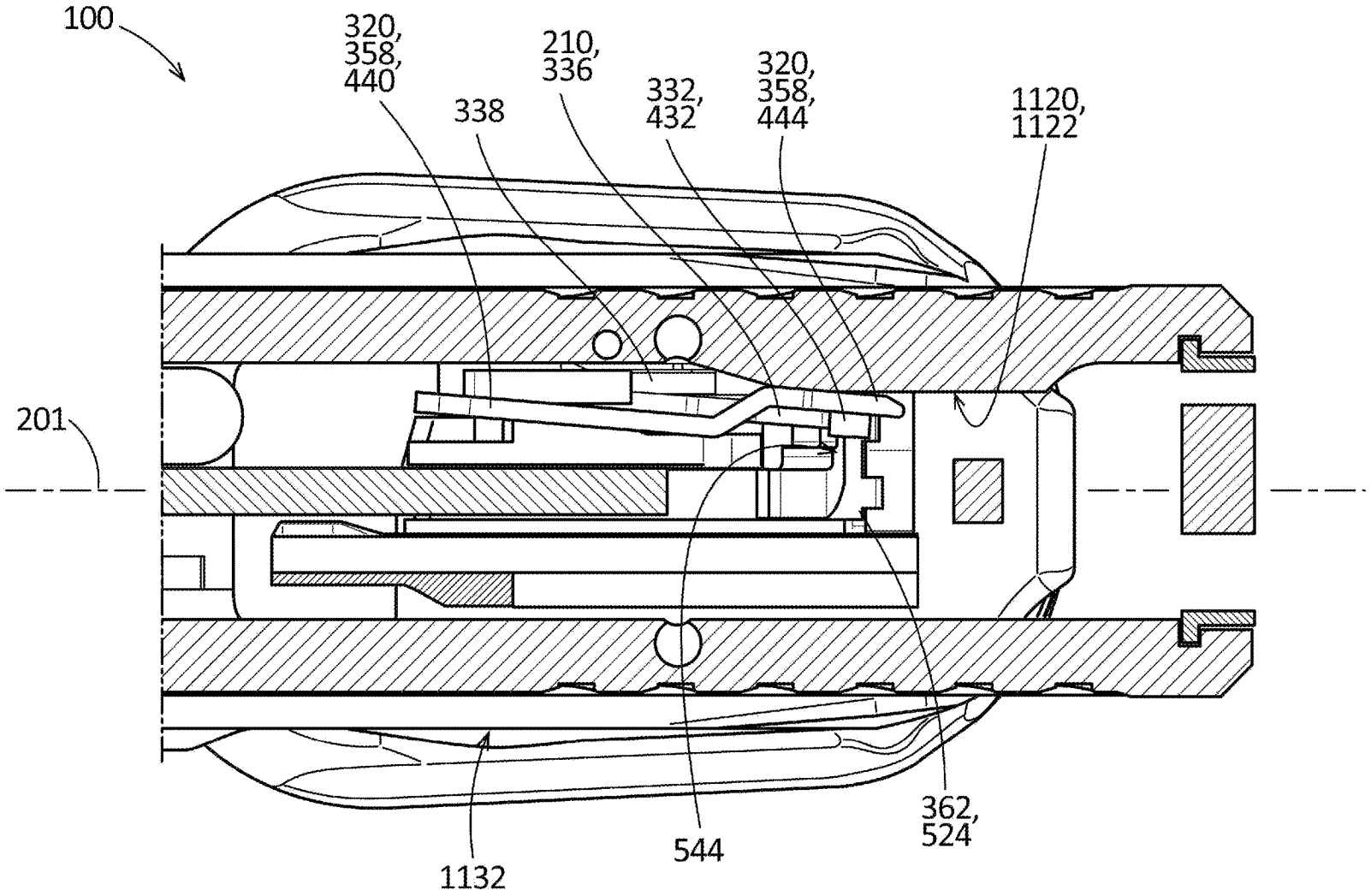
FIG. 13 is a detailed cross-sectional view of the firearm of FIG. 1 taken along Line 13-13 shown in FIG. 12.
Figure 14:
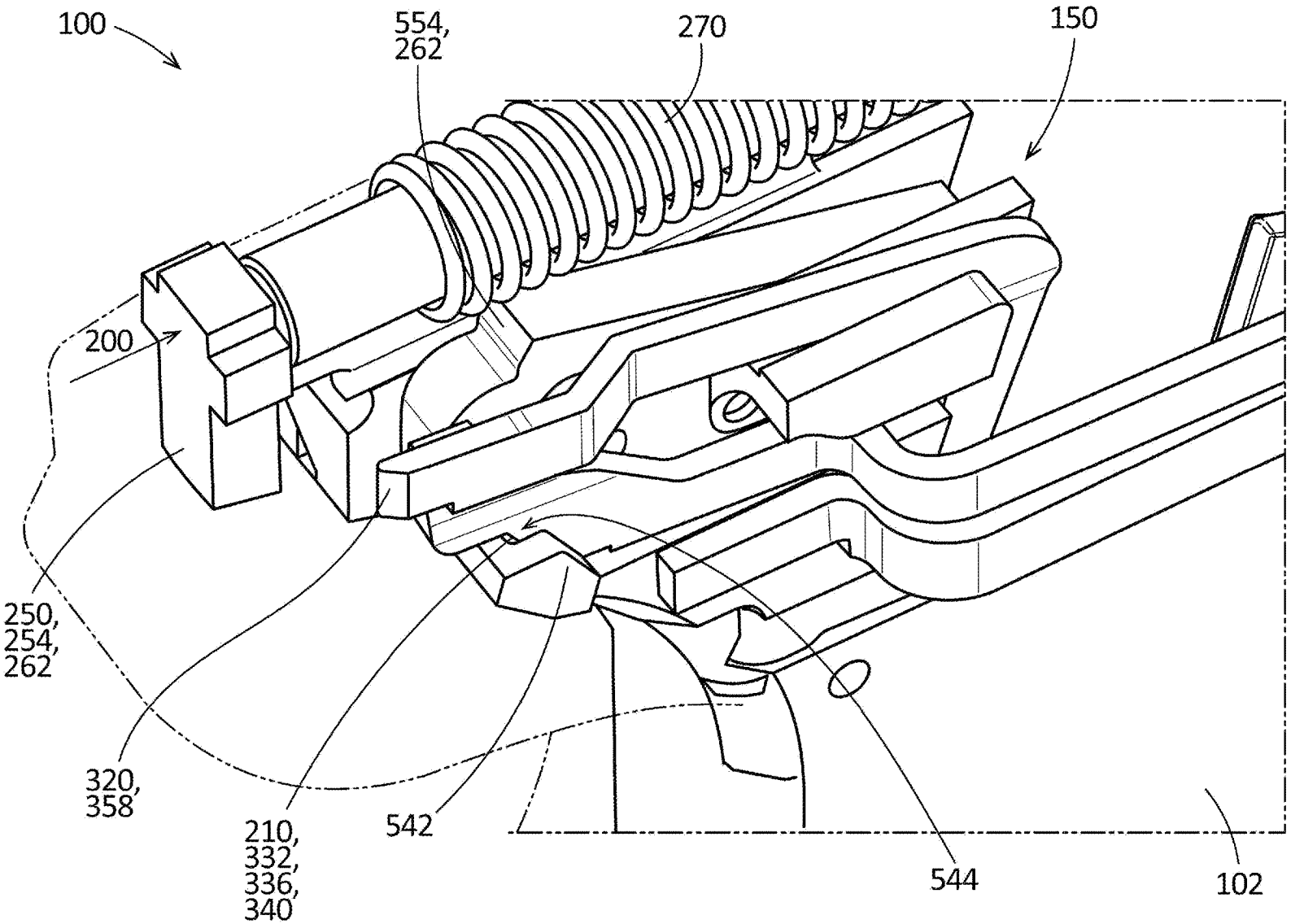
FIG. 14 is a detailed right-rear perspective view of the firearm of FIG. 1 with the slide hidden from view and the frame illustrated in transparency.

FIG. 13 is a detailed cross-sectional view of the firearm 100 taken along Line 13-13 shown in FIG. 12. FIG. 14 is a detailed perspective view of the right rear portion of the firearm 100 with the slide 104 hidden from view and the frame 102 illustrated in transparency.

As shown in FIG. 13, the upper arm 358 of the disconnector 320 can ride laterally up the rear transition contour 1126 and onto the inner surface 1122 of the disconnector ramp 1120, thereby resiliently deflecting the upper arm 358 of the disconnector 320 to the disconnected arm shape. Specifically, the rear portion 444 of the upper arm 358 can rest against the inner surface 1122 of the disconnector ramp 1120.

The deflection of the upper arm 358 to the disconnected arm shape can also resiliently deflect the upper leg 336 of the trigger bar 210 laterally inward to its disconnected leg shape through contact between the rear portion 444 of the upper arm 358 and the disconnector engagement tab 432. In their respective disconnected shapes of the upper arm 358 and the upper leg 336, the front portion 440 and the rear portion 444 of the upper arm 358 and the upper leg 336 can each be laterally angled towards the barrel axis 201. Additionally, the upper leg 336 can be misaligned from the lower leg 338 of the trigger bar 210 such that the upper leg 336 is no longer positioned directly over the lower leg 338 when the upper leg 336 is in the disconnected leg shape.

Additionally, in the disconnected leg shape, the rear end 332 of the upper leg 336 can be misaligned from the raised rib 542 (shown in FIG. 14) of the sear 362, thereby disengaging the sear engagement surface 340 (shown in FIG. 3) of the trigger bar 210 from the trigger bar engagement surface 342 (shown in FIG. 3) of the sear 362. Instead, the rear end 332 of the upper leg 336 can be positioned over the reset notch 544 of the sear 362.

With the rear end 332 of the upper leg 336 of the trigger bar 210 offset from the raised rib 542, the sear 362 is no longer held in the disengaged sear position (shown in FIG. 13). Due to the upward force F of the sear biasing member 462 (shown in FIG. 6) acting on the rear portion 524 of the sear 362, the sear 362 can reset to the engagement sear position, as shown in FIG. 14, by rotating around the sear pin 364 (shown in FIG. 3).

FIG. 14 is a detailed right-rear perspective view of the firearm 100 with the slide 104 (shown in FIG. 1) hidden from view and the frame 102 show in transparency. After firing a cartridge, the slide 104 (shown in FIG. 1) can return to the forward slide position due to a biasing force exerted by the recoil spring assembly 110 (shown in FIG. 1). The striker 254 can be carried in the forward direction 200 by the slide 104 until the sear engagement lug 262 contacts the striker engagement shoulder 554 of the sear 362, which can cease forward travel of the striker 254. The slide 104 can continue to travel forward to the forward slide position, thereby compressing the striker biasing member 270 and returning the fire control mechanism 250 to the cocked configuration.

Once the slide 104 returns to the forward slide position, the upper arm 358 of the disconnector 320 can be disengaged from the disconnector ramp 1120 (shown in FIG. 11) and can return to the default arm shape; however, the upper leg 336 of the trigger bar 210 can remain secured in the disconnected leg shape so long as the trigger bar 210 is held in its rearward position.

As shown, the rear end 332 of the upper leg 336, including the portion defining the sear engagement surface 340, can be positioned within the reset notch 544 of the sear 362, which can prevent the upper leg 336 from returning to the default leg shape until the trigger 214 (shown in FIG. 2) is released and the trigger bar 210 is allowed to return to the intermediate position, the forward position, or some position therebetween. Once the trigger bar 210 moves to the intermediate position (or further forward), the upper leg 336 can slide off the raised rib 542 and resiliently return to the default leg shape.

As referenced above, the upper leg 336 can act as a leaf spring, and the return of the upper leg 336 from the disconnected leg shape to the default leg shape can create tactile and/or auditory feedback to a user that the trigger mechanism 150 has reset. This feedback can inform the user that the firearm 100 is ready to fire again by pulling the trigger 214 again.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A trigger assembly comprising:

a sear defining a trigger bar engagement surface and a reset notch; and a trigger bar comprising an upper leg, the upper leg defining a sear engagement surface, the upper leg deflectable from a default leg shape to a disconnected leg shape, the sear engagement surface laterally aligned with the trigger bar engagement surface when the upper leg is in the default leg shape, the sear engagement surface laterally misaligned from the trigger bar engagement surface when the upper leg is in the disconnected leg shape.

2. The trigger assembly of claim 1, wherein the sear defines a reset notch, and wherein the sear engagement surface is laterally aligned with the reset notch when the upper leg is in the disconnected leg shape.

3. The trigger assembly of claim 2, wherein:

the sear defines a main portion and a trigger bar engagement arm extending laterally outward from the main portion;

the trigger bar engagement surface is defined at an end of the trigger bar engagement arm; and the reset notch is defined between the main portion and the trigger bar engagement surface.

4. The trigger assembly of claim 1, wherein the upper leg is resiliently deflectable in a lateral direction between the default leg shape and the disconnected leg shape.

5. The trigger assembly of claim 1, further comprising a disconnector defining an upper arm, the upper arm positioned in contact with the upper leg, the upper arm configured to deflect the upper leg from the default leg shape to the disconnected leg shape when the upper arm contacts a disconnector ramp of a slide.

6. The trigger assembly of claim 5, wherein:

the upper arm is configured to deflect from a default arm shape to a disconnected arm shape when the upper arm contacts the disconnector ramp of the slide; and the upper leg is positioned in the disconnected leg shape when the upper arm is in the disconnected arm shape.

7. The trigger assembly of claim 1, wherein:

the trigger bar further defines a lower leg;

the upper leg is aligned over the lower leg when the upper leg is in the default leg shape; and the upper leg is misaligned from the lower leg when the upper leg is in the disconnected leg shape.

8. A firearm comprising the trigger assembly of claim 1.

9. A method of operating a firearm comprising a trigger assembly, a frame, and a slide, the trigger assembly comprising a trigger bar, a sear, and a disconnector, the method comprising:

moving the trigger bar in a rearward direction from a forward trigger bar position to an intermediate trigger bar position with an upper leg of the trigger bar in a default leg shape to contact a sear engagement surface of the upper leg with a trigger bar engagement surface of the sear;

moving the trigger bar further in the rearward direction from the intermediate trigger bar position to a rearward trigger bar position to rotate the sear from an engagement sear position to a disengaged sear position due to contact between the sear engagement surface and the trigger bar engagement surface, the sear contacting a striker of the firearm in the engagement sear position;

releasing the striker of the firearm in a forward direction as the sear rotates from the engagement sear position to the disengaged sear position, releasing the striker causing the firearm to fire a cartridge;

moving the slide in the rearward direction relative to the frame to deflect an upper arm of the disconnector from a default arm shape to a disconnected arm shape; and deflecting the upper leg from the default leg shape to a disconnected leg shape through contact between the upper arm and the upper leg to misalign the sear engagement surface of the upper leg from the trigger bar engagement surface of the sear.

10. The method of claim 9, wherein deflecting the upper leg from the default leg shape to the disconnected leg shape comprises:

aligning the sear engagement surface of the upper leg with a reset notch of the sear; and resetting the sear from the disengaged sear position to the engagement sear position due to a biasing force applied to the sear by a sear biasing member of the trigger assembly.

11. The method of claim 10, resetting the sear from the disengagement sear position to the engagement sear position comprises engaging a striker engagement shoulder of the striker with a sear engagement lug of the striker as the slide travels in the forward direction relative to the frame.

12. The method of claim 9, further comprising pulling a trigger of the trigger assembly to move the trigger bar in the rearward direction from the forward trigger bar position to the rearward trigger bar position, the trigger coupled to the trigger bar.

13. The method of claim 9, wherein the upper leg is secured in the disconnected leg shape by the reset notch when the trigger bar is in the rearward trigger bar position and sear is reset to the engagement sear position, and wherein the method further comprises moving the trigger bar in the forward direction from the rearward trigger bar position to release the upper leg from the reset notch and resiliently deflect the upper leg to the default leg shape.

14. The method of claim 9, wherein moving the slide in the rearward direction relative to the frame to deflect the upper arm of the disconnector from the default arm shape to the disconnected arm shape comprises contacting the upper arm with a disconnector ramp of the slide as the slide travels in the rearward direction relative to the frame, the disconnector ramp extending laterally inward from a slide rail of the slide.

* * * * *